US005316404A

United States Patent [19]

Hensel

[11] Patent Number: 5,316,404

[45] Date of Patent: May 31, 1994

[54] PAGE WITH PICTURE POCKETS AND ALBUM CONTAINING SUCH PAGES

[76] Inventor: James T. Hensel, 303 Bloomingrove Dr., Troy, N.Y. 12180

[21] Appl. No.: 905,339

[22] Filed: Jun. 29, 1992

[51] Int. Cl.[5] ..... B42F 13/00

[52] U.S. Cl. ..... 402/79; 40/159

[58] Field of Search ..... 402/79; 40/159, 159.2; 281/31, 38, 15.1, 21.1, 22, 31

[56] References Cited

U.S. PATENT DOCUMENTS

| | | | |
|---|---|---|---|
| D. 316,107 | 4/1991 | Lockner | D19/20 |
| 1,956,527 | 4/1934 | DeGroot | 40/159 |
| 1,977,667 | 6/1934 | Breitkreuz | 129/20 |
| 2,176,292 | 10/1939 | Brown et al. | 40/159 |
| 2,310,722 | 2/1943 | Weinger | 281/22 |
| 3,797,146 | 3/1974 | Holes | 40/104.18 |
| 3,879,875 | 4/1975 | Schneider | 40/159 |
| 4,356,649 | 11/1982 | Diamond et al. | 40/159 |
| 4,577,889 | 3/1986 | Schulz | 281/15 R |
| 4,629,070 | 12/1986 | Roberg | 206/455 |
| 4,704,042 | 11/1987 | Eisen et al. | 402/79 |
| 4,954,003 | 9/1990 | Shea | 402/79 |
| 5,000,319 | 3/1991 | Mermelstein | 206/455 |
| 5,031,773 | 7/1991 | Manico et al. | 206/455 |
| 5,080,223 | 1/1992 | Mitsuyama | 206/39.5 |

*Primary Examiner*—Mark Rosenbaum
*Assistant Examiner*—Willmon Fridie, Jr.
*Attorney, Agent, or Firm*—Heslin & Rothenberg

[57] ABSTRACT

A storage page for holding stacked groups of photographic prints so that the topmost print in the stack is visible and an album containing such pages are disclosed. The storage page comprises (a) a rigid page backing; and (b) a plurality of expandable, flexible pockets mounted thereon. Each of the pockets has a transparent front wall and side and bottom walls of sufficient width to accommodate 10 to 40 photographic prints.

13 Claims, 8 Drawing Sheets

FIG. 4A
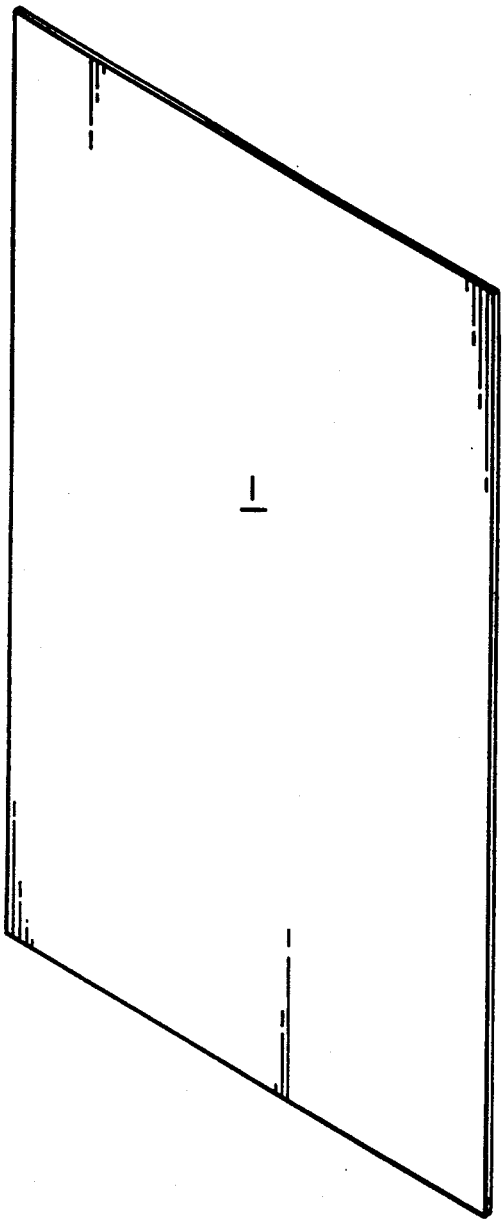
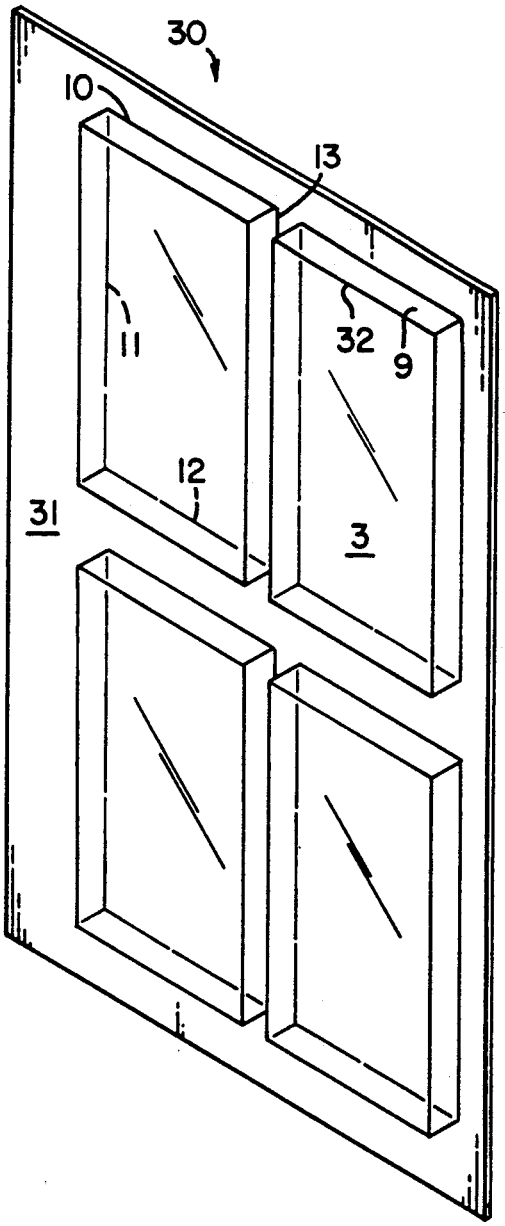
FIG. 4B

PAGE WITH PICTURE POCKETS AND ALBUM CONTAINING SUCH PAGES

FIELD OF THE INVENTION

The invention relates to a storage page for holding stacked groups of photographic prints so that the topmost print in the stack is visible. The invention also relates to an album containing such pages.

BACKGROUND

Each year untold numbers of photographs are developed, looked at and stuffed in a drawer or cupboard. The photographer usually has good intentions of putting them into a photo album, but never quite gets around to it because of the time required to mount individual photographs. They remain in the drawer where they are subject to loss and damage.

There is thus a need for a storage system whereby whole sets of prints can be stored where they can be protected, and in a manner such that a set can be readily identified.

Numerous systems and devices are known for storing and protecting individual photographic prints.

U.S. Pat. No. 2,310,722 (Weinger) discloses a method for producing photographic albums. The photograph album comprises, in addition to the usual cover and backbone, a series of main leaves, and each of the main leaves supports secondary leaves. In the example shown, the secondary leaves allow the mounting of nine photographic prints upon each face. Each pocket is designed to hold a single photograph.

U.S. Pat. No. 3,797,146 (Holes) discloses an album having pocketed album pages. A plurality of elongate rectangular transparent strips formed of a suitable plastic are applied to one surface of the sheet and are capable of accommodating several small photographs side by side. Each of the strips has a converging, wedge-shaped lower portion which serves to grip the lower edge portion of the picture to prevent sliding and movement of the photograph in the pocket.

U.S. Pat. No. 4,629,070 (Roberg) discloses transparent plastic film holders containing a plurality of pockets for strips of photographic film negatives or prints. The preferred embodiment provides pockets for a length of film strip or a length of negative. The film holder is constructed from two layers of transparent plastic film which are bonded or sealed together along a series of parallelspaced sealing lines. Each pocket is designed to hold a single strip.

U.S. Pat. No. 4,704,042 (Eisen et al.) discloses a register for maintaining photographs of items of property along with a description of the items in the photographs. The register includes a loose leaf binder with a loose leaf page having one section containing an inventory record which is hinged to a section containing photographs. The photographs are held in transparent pockets and each pocket receives a photograph or a slide transparency or other illustrative documentation.

U.S. Pat. No. 5,000,319 (Mermelstein) discloses a transparent plastic storage page which includes a plurality of parallel, laterally extending, top-loading pouches for accommodating film negatives. The storage pages are formed by overlaying a pair of matching translucent or transparent sheets and fastening the sheets together by a series of sealing dots. Each pocket or pouch so formed holds a single strip of photographic negative.

U.S. Pat. No. 5,031,773 (Manico et al.) discloses a photographic image set which insures that negatives are retained with the positive images or prints corresponding to them. In all of the embodiments each pocket contains only one of either a strip of negative or a positive print.

U.S. Pat. No. Des. 316,107 (Lockner) discloses an ornamental design for a dated holder for maintaining and displaying lesson planning cards. It appears from the design that the holder includes a plurality of pockets each holding single lesson planning card.

None of the foregoing references discloses a page having a pocket or pockets which were designed to hold a plurality of photographic prints in such fashion that only one of the prints in the stack was visible. All of the devices of the art relating to display of photographs have in common the shortcoming of requiring individually mounting or inserting each object.

Display pages are also known in arts other than the photographic art. For example, U.S. Pat. No. 1,977,667 (Breitkreuz) discloses a page for a stamp collector's album; the page is provided with pockets or pouches for removably receiving stamps such that each stamp may be individually viewed. U.S. Pat. No. 4,954,003 (Shea) discloses a coupon organizer for organizing and holding coupons for shopping items; each page comprises a pair of pockets upon each side of a center piece. The center piece is a sheet of plastic to which the pockets have been heat-sealed on each side. U.S. Pat. No. 5,080,223 (Mitsuyama) discloses a card case made of two rectangular sheets of plastic produced by fusing three edges thereof; the case is provided with a hole through which a fingertip may be inserted to push a card through the open side. Finally, U.S. Pat. No. 4,577,889 (Schulz) discloses a bag book made from a plurality of paper bags. Each bag forms a page of the book and provides a pocket having capacity to retain a plurality of items, none of which can be viewed without removing them from the bag.

It is an object of the invention to provide a storage system and device whereby prints from a whole roll of film can be stored at once.

It is a further object to provide a device wherein a stack of prints can be protected while still allowing one to view one of the prints in the stack and thereby identify the stack.

These and other objects and features are provided by the present invention.

SUMMARY OF THE INVENTION

The invention relates to a storage page for holding a plurality of photographic prints comprising:

(a) a rigid page backing; and (b) a plurality of expandable, flexible pockets mounted thereon, each of said pockets having a transparent front wall, first and second side walls and a bottom; said side walls and bottom being of sufficient width to accommodate 10 to 40 photographic prints.

A preferred storage page comprises, in addition, a plurality of tabs or fastening devices mounted on the rigid page adjacent the open end of the pocket and adapted so that each of the tabs encloses the photographic prints on a fourth side and prevents them from sliding out of the pockets. A distal portion of each of the tabs may slidingly engage an inside face of the front wall whereby pressure from the prints maintains the tab against the front wall. In a preferred embodiment, the side walls and bottom, together with a base portion of the tab, extend outwardly from the page backing a distance of from 3 mm to 15 mm. The storage page may have means for holding the storage page in a ring-binder or means for hanging it in a hanging file. A preferred storage page is in the form of a rectangle having a shorter dimension of from 21 to 25 cm and a longer dimension of from 26 to 35 cm with the side walls parallel to the longer dimension of said page. The page may have two, three or four pockets and each pocket most preferably holds 24 or 36 prints.

The invention further relates to an album comprising:

(a) generally rectangular front and rear covers;

(b) page retaining means; and (c) at least one page for being retained in the album. The page consists of a rigid page backing having means along an edge thereof for cooperating with the page retaining means for being retained in the album. The page is described above.

The retaining means is preferably either a plurality of rings of posts and corresponding apertures.

BRIEF DESCRIPTION OF DRAWINGS

FIG. 4(A–B) shows pieces of plastic of appropriate contour for fabricating a storage page by one method of assembly.

DESCRIPTION OF PREFERRED EMBODIMENTS

Figure 1:
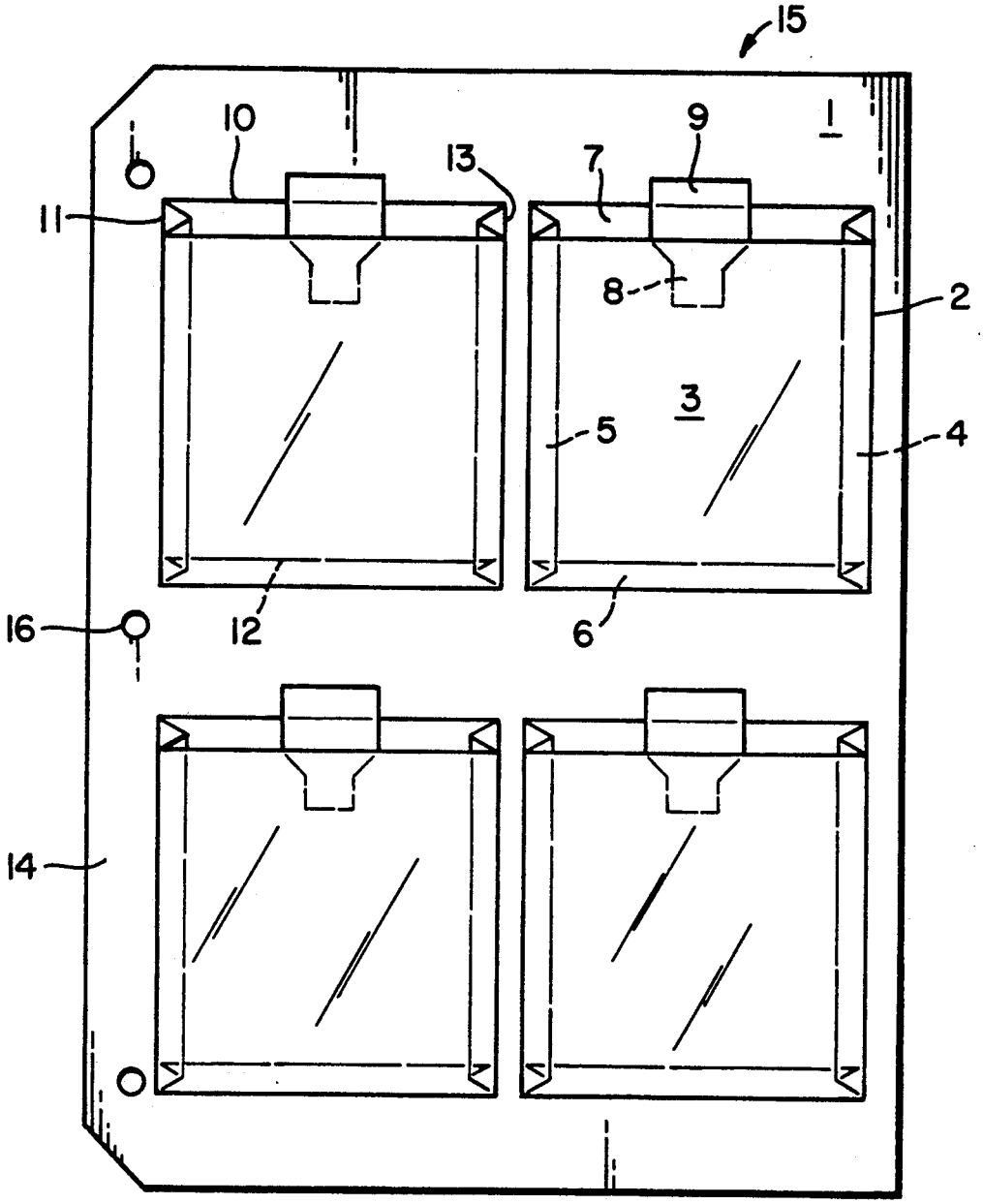
FIGS. 1, 2, and 3 depict alternate embodiments of storage pages according to the invention.

Referring to the drawings, FIG. 1 shows a storage page 15 formed of a rigid backing 1 and having four pockets 2. Each pocket has a transparent front wall 3, first and second side walls, 4 and 5, and a bottom 6, a back wall 7 and a tab 8, which in this embodiment has widened base 9 to cover photographs (not shown) when they are in the pocket. Any tough, transparent plastic film, such as polyethylene, polyvinylchloride, polyester, triacetate and, preferably, polypropylene, would be suitable for use in preparing the pockets. The sheets or plies of plastic film are bonded or sealed together along a series of sealing lines 10, 11, 12, and 13. The pockets, in general, have a length and width approximately equal to the height and length of photographic prints which are to be inserted in the pockets. Although the front wall 3 should be transparent, it is not necessary that the other faces of the pocket or the rigid backing be transparent. For ease in fabrication it will often be the case that all of the parts are transparent.

The sealing lines are preferably formed by heat, RF ultra sound or the like sealing so that the two faces are fused together at their point of contact with sufficient strength to define the retaining pockets. Other means of forming the bonding lines, such as gluing the films together, may also be employed.

The storage page for photographic prints 15 is of a size that can be fitted into a book, such as a ring binder, post binder, or suspension file for storage, carrying and/or use. To accommodate such use, a reinforcement strip 14 of paper, plastic or the like may be bonded across the top (not shown) or side edge of the page for punch holes 16, which enable insertion in a ring binder and/or a slot for insertion (not shown) of a support bar for hanging files.

Figure 2:
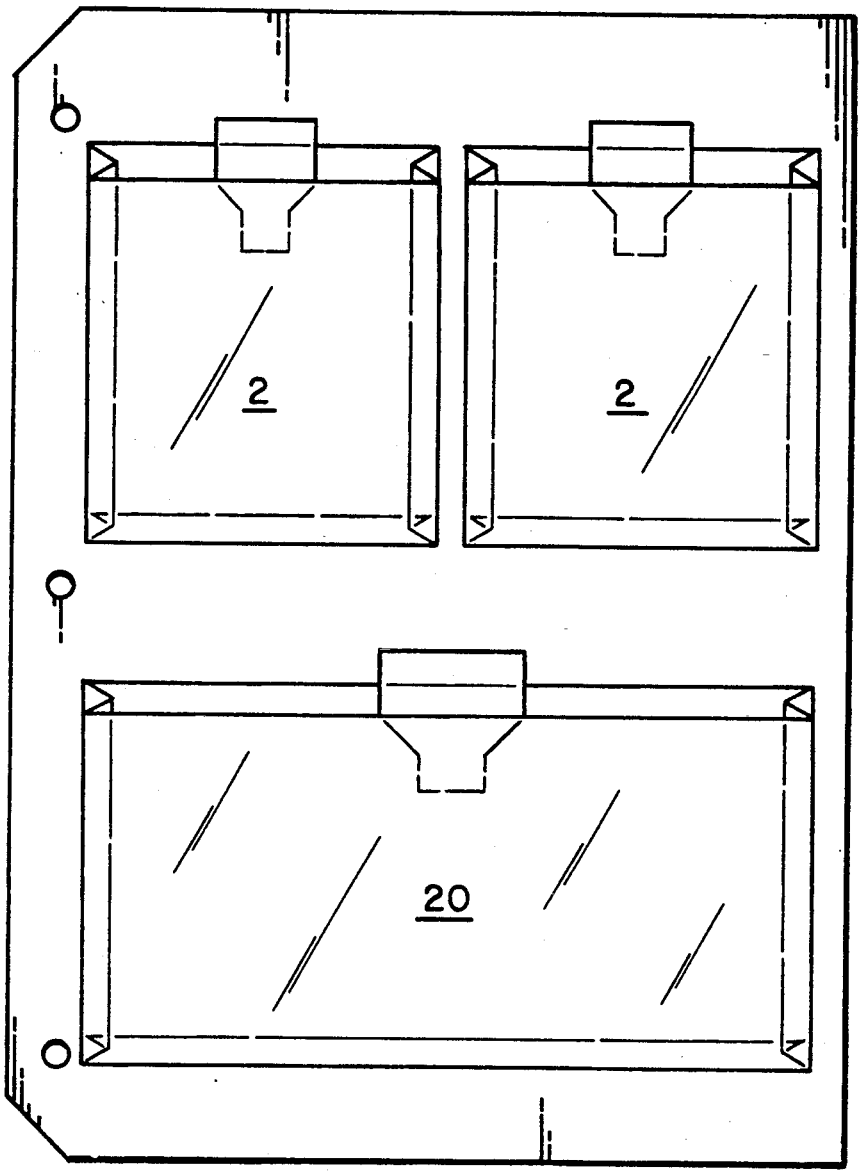
Figure 3:
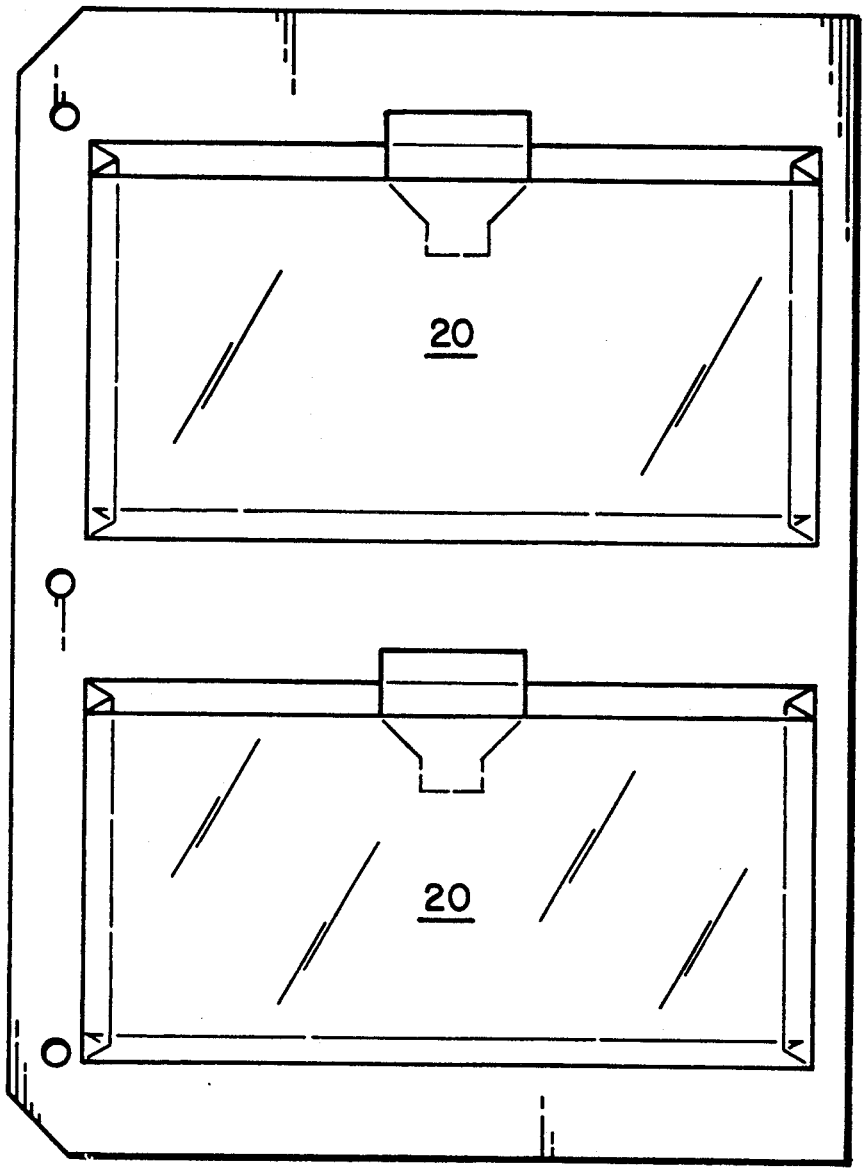

Referring now to FIG. 2, there is shown an alternate embodiment of the page of the invention which comprises three pockets, 2, 2, and 20. This embodiment also illustrates that the pockets need not be the same size or orientation, although they should be of a size to accommodate standard photographic prints (e.g. slightly larger than $3\frac{1}{2}\times5$ and $5\times8$). FIG. 3 shows a third embodiment having two pockets, 20 and 20.

FIG. 4 illustrates a method of fabricating a storage page 30 from two sheets of plastic. A rigid, planar page backing 1 is sealed to a contoured, transparent cover sheet 31 along lines 10, 11, 12 and 13 to form pockets 2. A slit 32 is cut along one edge of the front wall 3 to form a base 9 of a tab. If desired, an extension of the tab may be added to the base 9 so that the extension may be tucked into the pocket. Alternatively, the base 9 may be removed entirely and an open pocket provided.

Figure 5A:
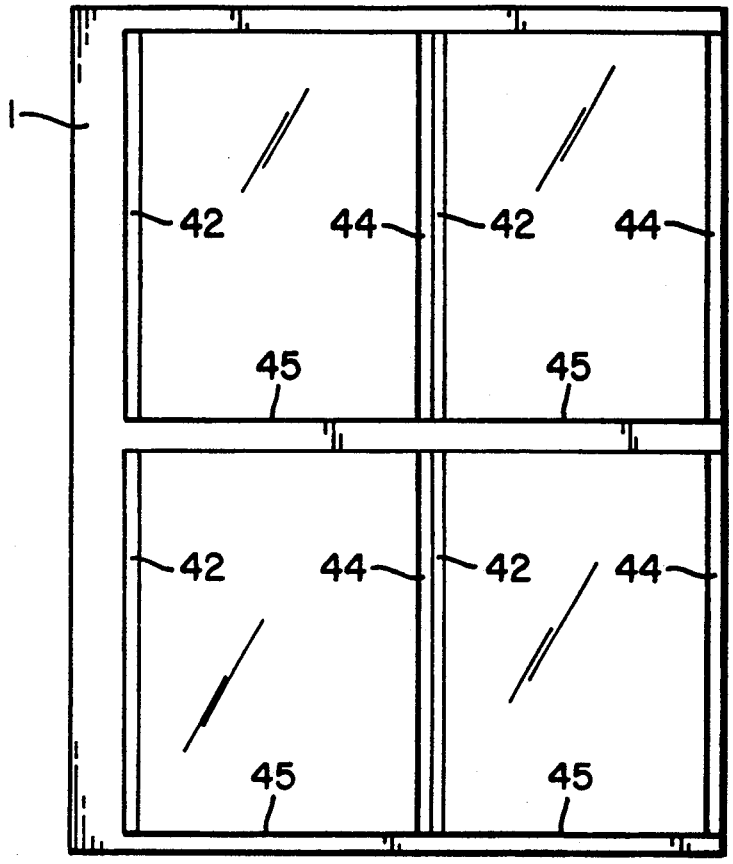
FIGS. 5(A–C) and 6(A–C) show pieces of plastic of appropriate shape for fabricating a storage page by an alternate method.
Figure 5B:
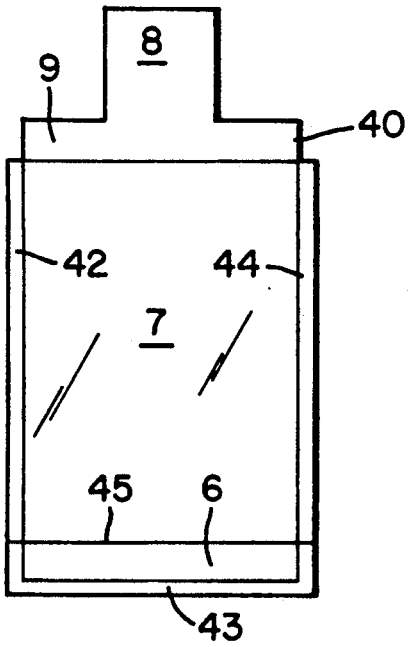
Figure 5C:
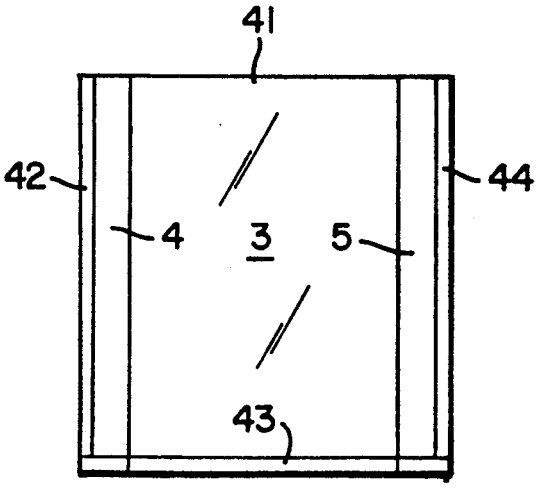
Figure 6A:
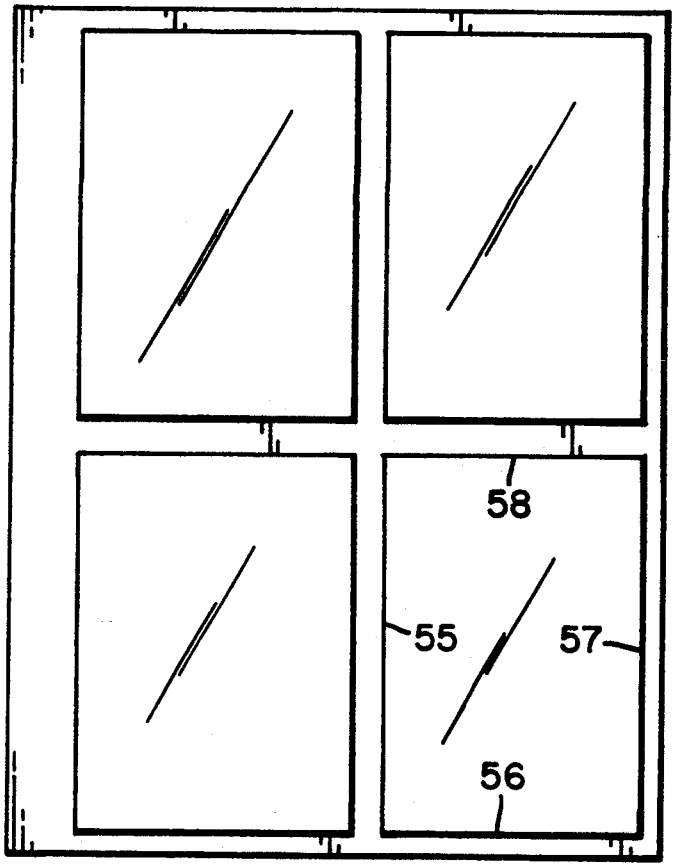
Figure 6B:
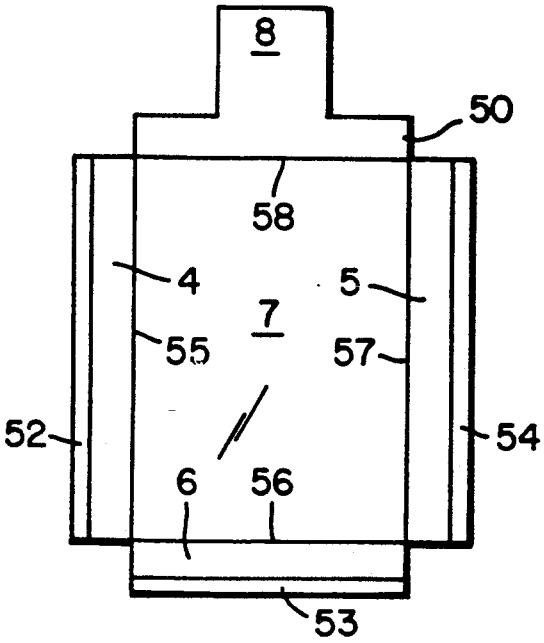
Figure 6C:
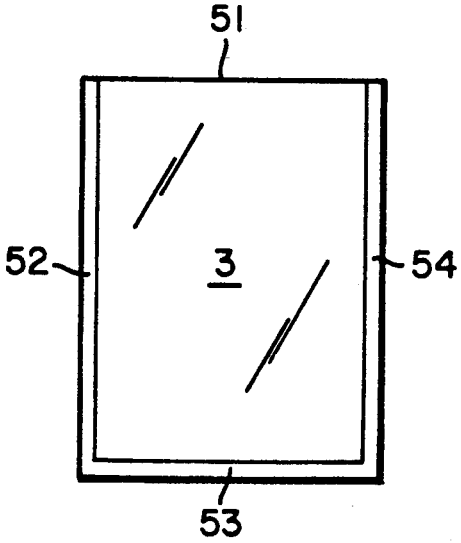

FIG. 5 illustrates a second method of fabricating a storage page according to the invention. In this case a first piece of plastic 40, is cut so as to provide for the back wall 7, the tab 8 and 9 and the bottom 6; a second piece of plastic 41 is cut so as to provide for the first 4 and second 5 side walls and the front wall 3. The two are bonded to each other along sealing surfaces 42, 43 and 44 and also are bonded to rigid page backing 1 along surfaces 42 and 44 and along line 45. FIG. 6 shows a second arrangement of these same elements wherein one piece 50 provides the tab 8, back 7, bottom 6 and sides 4 and 5, and the second, transparent piece 51, provides the front wall 3. In this case piece 50 is bonded to piece 51 along the edges 52, 53 and 54 and to the backing 1 along edges 55, 56, 57 and 58 or all of the back wall 7.

Alternate means using conventional materials and methods known to those of skill in the art may be used, as well, to fabricate storage pages of the invention.

Figure 7:
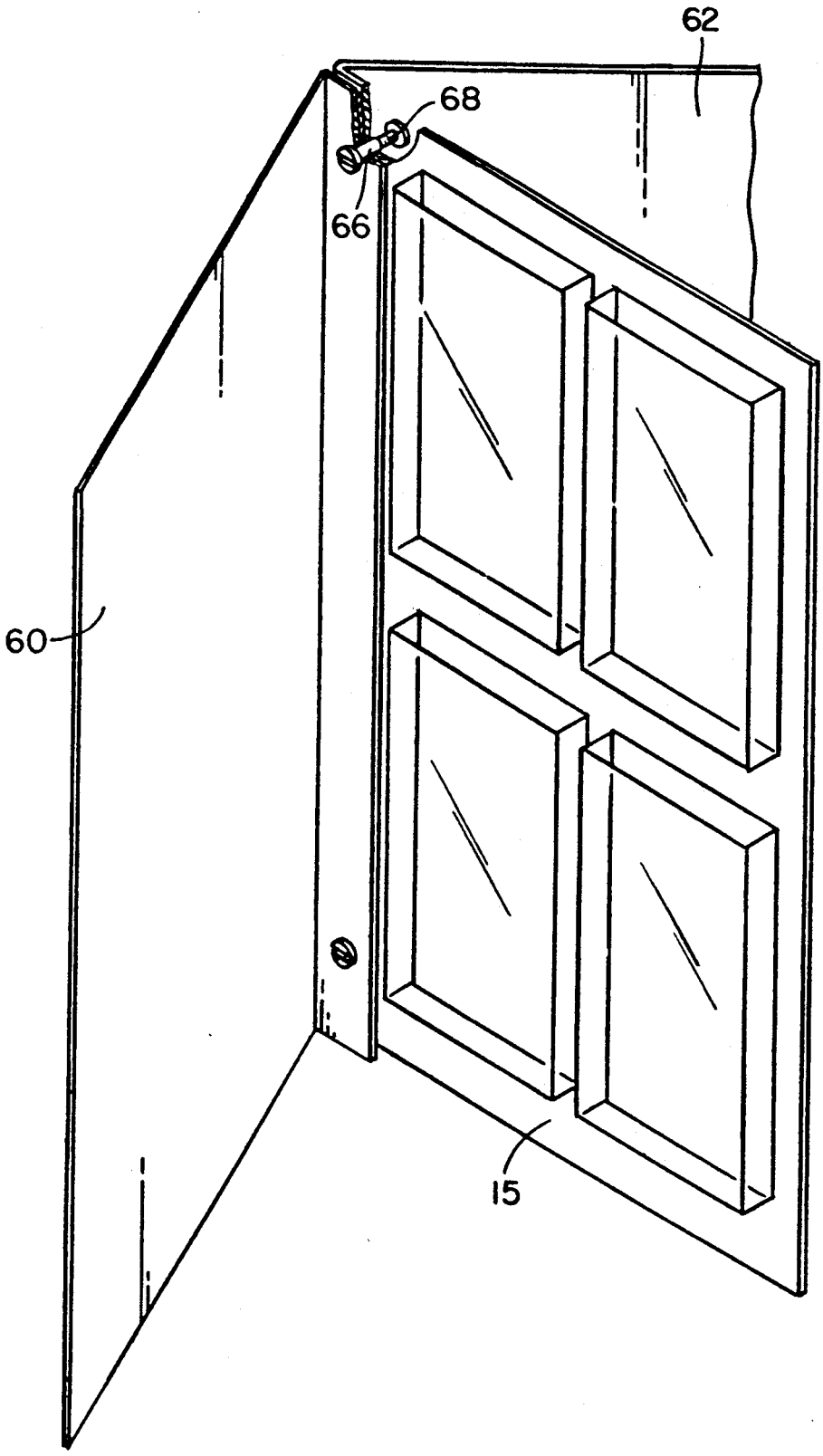
FIGS. 7 and 8 are perspective views of albums incorporating storage pages according to the invention.
Figure 8:
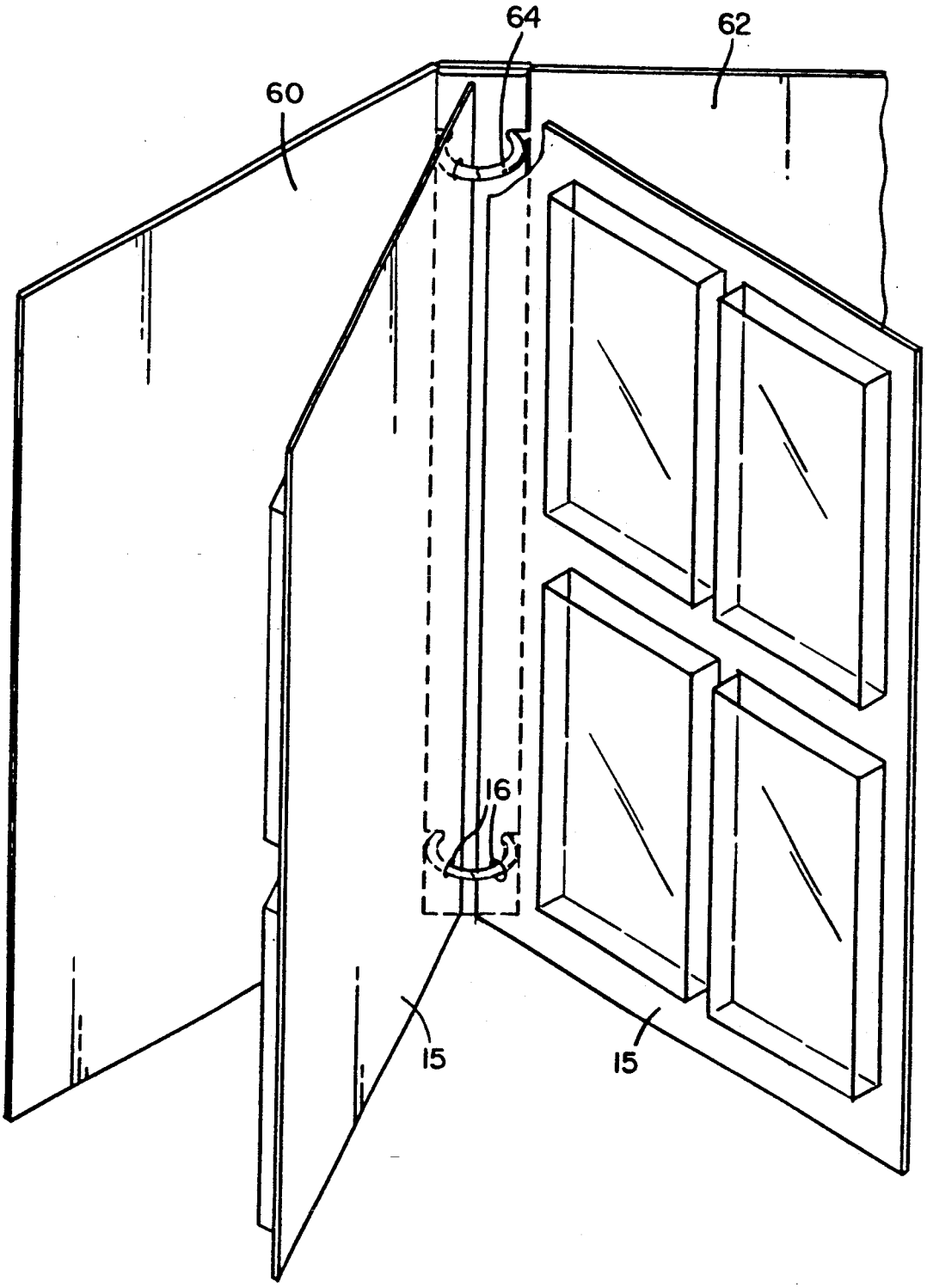

The invention also provides an album containing the novel pocket pages, which is not only of simple and readily available construction, but which facilitates the use of the pages with respect to storing and protecting batches of photographs in a manner such that they can be readily located. Ring binders and post binders, which are well suited to fabricating such albums, are well known in the art. FIG. 7 and FIG. 8 illustrate albums having front and rear covers 60 and 62 and page retaining means, which in FIG. 7 are posts 66 and means for detachably fastening the posts in the form of threaded caps 68. In FIG. 8 the posts are replaced by openable rings 64 passing through the apertures or punch holes 16 of a typical page 15.

While the invention has been particularly shown and described with reference to preferred embodiments thereof, it will be understood by those skilled in the art that other changes in form and details may be made therein without departing from the spirit and scope of the invention.

I claim:

1. A storage page for holding a plurality of photographic prints comprising:

(a) a rigid page backing; and (b) a plurality of expandable, flexible pockets mounted thereon, each of said pockets having (i) a transparent front wall, (ii) first and second side walls, (iii) a bottom, and (iv) a tab;

said side walls and bottom being of sufficient width to accommodate 10 to 40 photographic prints, and said tabs mounted on said rigid page backing adjacent and above said pockets and adapted so that each of said tabs encloses said photographic prints on a fourth side and prevents said prints from sliding out of said pockets.

2. A storage page according to claim 1 wherein said side walls and said bottom, together with a base portion of said tab, extend outwardly from said page backing a distance of from 3 mm to 15 mm.

3. A storage page according to claim 1 further characterized in having means for holding said storage page in a ring-binder.

4. A storage page according to claim 1 further characterized in having means for hanging said storage page in a hanging file.

5. A storage page according to claim 1 wherein said tabs and said pockets are adapted to allow a distal portion of each of said tabs to slidingly engage an inside face of said front wall whereby pressure from said prints maintains said tab against said inside face of said front wall.

6. A storage page according to claim 2 wherein said rigid page backing is in the form of a rectangle having a shorter dimension of from 21 to 25 cm and a longer dimension of from 26 to 35 cm.

7. A storage page according to claim 5 wherein said pocket side walls are parallel to the longer dimension of said page.

8. A storage page according to claim 7 comprising four pockets each adapted to hold 24 to 36 prints.

9. A storage page according to claim 7 comprising three pockets.

10. A storage page according to claim 7 comprising two pockets.

11. An album comprising:

(a) generally rectangular front and rear covers;

(b) page retaining means;

(c) at least one page for being retained in said album, said page consisting of a rigid page backing, said backing having means along an edge thereof for cooperating with said page retaining means for being retained in said album, and having a plurality of expandable, flexible pockets mounted thereon, each of said pockets having (i) a transparent front wall, (ii) first and second side walls, (iii) a bottom and (iv) a tab; said side walls and bottom being of sufficient width to accommodate 10 to 40 photographic prints and said tabs mounted on said rigid page adjacent and above said pockets and adapted so that each of said tabs encloses said photographic prints on a fourth side and prevents said prints from sliding out of said pockets.

12. An album according to claim 11 wherein said page retaining means include a plurality of rings which are openable and closeable, and said means along said edge of said rigid backing for cooperating with said page retaining means includes a plurality of apertures for receiving respective ones of said rings.

13. An album according to claim 11 wherein said page retaining means include a plurality of posts and means for detachably fastening said posts to said covers such that said covers may be opened and closed with respect to one another, and said means along said edge of said rigid backing for cooperating with said page retaining means includes a plurality of apertures for receiving respective ones of said posts.

* * * * *